US009521869B2

(12) United States Patent
Weiss et al.

(10) Patent No.: US 9,521,869 B2
(45) Date of Patent: Dec. 20, 2016

(54) BODY PROTECTING ELEMENTS FOR USE WITH SPORTS APPAREL TO PROTECT A WEARER FROM IMPACT AND FRICTIONAL FORCES

(75) Inventors: Robert L. Weiss, Weston, CT (US); Frank J. Avellanet, Westport, CT (US); Mark Peyser, Easton, CT (US)

(73) Assignee: WISER PRODUCTS, Westport, CT (US)

( * ) Notice: Subject to any disclaimer, the term of this patent is extended or adjusted under 35 U.S.C. 154(b) by 1168 days.

(21) Appl. No.: 13/085,946

(22) Filed: Apr. 13, 2011

(65) Prior Publication Data

US 2011/0252548 A1 Oct. 20, 2011

Related U.S. Application Data

(60) Provisional application No. 61/324,970, filed on Apr. 16, 2010.

(51) Int. Cl.

| | |
|---|---|
| ***A41D 13/00*** | (2006.01) |
| ***A41D 13/05*** | (2006.01) |
| ***A41D 13/015*** | (2006.01) |
| *A41D 13/01* | (2006.01) |

(52) U.S. Cl.

CPC ..... *A41D 13/05* (2013.01); *A41D 13/015* (2013.01); *A41D 13/0556* (2013.01); *A41D 13/01* (2013.01)

(58) Field of Classification Search

CPC ... A41D 13/0506; A41D 27/26; A41D 13/015
USPC ..... 2/465, 22, 23, 244; 128/846; 24/459
See application file for complete search history.

(56) References Cited

U.S. PATENT DOCUMENTS

| | | | | |
|---|---|---|---|---|
| 848,212 | A * | 3/1907 | Shelton | 24/340 |
| 1,333,075 | A * | 3/1920 | Hill et al. | 24/459 |
| 2,089,221 | A * | 8/1937 | Patur et al. | 24/5 |
| 2,561,872 | A | 2/1950 | Krinick | |
| 2,798,389 | A * | 7/1957 | Sackrider | 79/5 |
| 3,237,262 | A * | 3/1966 | Decker | 24/163 FC |
| 3,392,729 | A * | 7/1968 | Lenoir | 606/234 |
| 3,542,034 | A * | 11/1970 | Klein | 450/111 |
| 3,865,290 | A * | 2/1975 | Sperling | 224/194 |
| 4,185,670 | A | 1/1980 | Sartell, Jr. | |

(Continued)

*Primary Examiner* — Sally Haden
(74) *Attorney, Agent, or Firm* — Leason Ellis LLP

(57) ABSTRACT

The present invention is directed to a human body protecting element for use with and attachment to an article of clothing, such as sports apparel, to protect a wearer from impact and frictional forces, such as road rash. One exemplary body protecting element includes a first part having a first locking member. The first part is for placement along an inner surface of the article of clothing. The body protecting element also includes a second part having a second locking member that is complementary to the first locking member and results in a mechanical coupling (e.g., a snap-fit attachment) between the first and second parts when the first and second locking members engage one another. The second part is for placement along an outer surface of the article of clothing and includes an outer ground contacting contoured surface. The ground contacting surface provides a high impact surface that is contoured so that if the wearer contacts and/or slides across the ground, the ground contacting surface protects the wearer by shielding the wearer's body from the abrasive ground surface.

20 Claims, 14 Drawing Sheets

(56) References Cited

U.S. PATENT DOCUMENTS

| | | | | | |
|---|---|---|---|---|---|
| 4,308,647 | A | * | 1/1982 | Gillis | 24/460 |
| 4,559,675 | A | * | 12/1985 | Devenny | 24/5 |
| 4,580,297 | A | | 4/1986 | Maejima | |
| 4,641,641 | A | * | 2/1987 | Strock | 128/846 |
| 4,665,591 | A | * | 5/1987 | Servay | 24/163 K |
| 4,793,155 | A | * | 12/1988 | Law | 63/40 |
| 4,810,559 | A | | 3/1989 | Fortier et al. | |
| 4,901,408 | A | * | 2/1990 | Hermann | 24/637 |
| 4,926,883 | A | * | 5/1990 | Strock | 128/888 |
| 4,985,968 | A | * | 1/1991 | Hooper | 24/302 |
| 4,996,989 | A | * | 3/1991 | Stundel et al. | 600/383 |
| 5,020,547 | A | * | 6/1991 | Strock | 128/891 |
| 5,033,170 | A | * | 7/1991 | Ewert | 24/459 |
| 5,046,222 | A | * | 9/1991 | Byers et al. | 24/343 |
| 5,131,671 | A | | 7/1992 | Wilhelms | |
| 5,137,430 | A | | 8/1992 | Alioto | |
| 5,143,390 | A | | 9/1992 | Goldsmith | |
| 5,158,218 | A | | 10/1992 | Wery | |
| 5,168,576 | A | * | 12/1992 | Krent et al. | 2/456 |
| 5,195,220 | A | * | 3/1993 | Herman | 24/113 R |
| 5,373,584 | A | | 12/1994 | Parcells, III | |
| 5,397,144 | A | | 3/1995 | Mirand et al. | |
| 5,462,170 | A | * | 10/1995 | Colgate | 206/574 |
| 5,511,289 | A | * | 4/1996 | Melia | 24/66.9 |
| 5,531,231 | A | * | 7/1996 | Morrissey et al. | 128/846 |
| 5,557,804 | A | * | 9/1996 | Ovortrup et al. | 2/23 |
| 5,557,830 | A | * | 9/1996 | Davis | 24/459 |
| 5,655,271 | A | * | 8/1997 | Maxwell-Trumble et al. | 24/459 |
| 5,732,714 | A | * | 3/1998 | Morrissey et al. | 128/846 |
| 5,794,275 | A | | 8/1998 | Donzis | |
| 5,851,017 | A | | 12/1998 | Eden | |
| 5,940,942 | A | * | 8/1999 | Fong | 24/459 |
| 6,029,273 | A | | 2/2000 | McCrane | |
| 6,041,447 | A | | 3/2000 | Endler | |
| 6,098,208 | A | | 8/2000 | Cordon | |
| 6,174,075 | B1 | * | 1/2001 | Fuwausa | 362/310 |
| 6,195,809 | B1 | * | 3/2001 | Garcia | 2/455 |
| 6,227,810 | B1 | | 5/2001 | Huang et al. | |
| 6,334,443 | B1 | * | 1/2002 | Olsen | 128/846 |
| 6,745,406 | B2 | * | 6/2004 | Ruane | 2/465 |
| D505,753 | S | * | 5/2005 | Qvortrup | D29/100 |
| 7,182,085 | B1 | * | 2/2007 | Larsen et al. | 128/846 |
| 7,216,404 | B1 | * | 5/2007 | Doyle | 24/573.11 |
| 7,484,250 | B2 | * | 2/2009 | Chiang | 2/465 |
| 7,784,158 | B2 | * | 8/2010 | Doyle | 24/114.12 |
| 8,151,376 | B2 | * | 4/2012 | Onrot et al. | 2/465 |
| 8,327,510 | B2 | * | 12/2012 | Schlesinger | 24/459 |
| 8,347,416 | B1 | * | 1/2013 | Query | 2/265 |
| 8,671,595 | B2 | * | 3/2014 | Nelson | 36/136 |
| 8,732,869 | B2 | * | 5/2014 | Onrot et al. | 2/465 |
| 2003/0079277 | A1 | | 5/2003 | Gillen et al. | |
| 2003/0156950 | A1 | | 8/2003 | Ostrowiecki | |
| 2004/0168286 | A1 | * | 9/2004 | Herman | 24/513 |
| 2006/0005292 | A1 | | 1/2006 | Crye et al. | |
| 2006/0107433 | A1 | * | 5/2006 | Olson | 2/22 |
| 2008/0282456 | A1 | * | 11/2008 | Chiang | 2/465 |
| 2009/0199325 | A1 | * | 8/2009 | Fuwausa et al. | 2/244 |
| 2009/0307829 | A1 | * | 12/2009 | Onrot et al. | 2/465 |
| 2010/0090439 | A1 | | 4/2010 | White | |
| 2010/0251459 | A1 | * | 10/2010 | Schlesinger | 2/232 |

* cited by examiner

BODY PROTECTING ELEMENTS FOR USE WITH SPORTS APPAREL TO PROTECT A WEARER FROM IMPACT AND FRICTIONAL FORCES

CROSS-REFERENCE TO RELATED APPLICATION

The present application claims the benefit of U.S. patent application No. 61/324,970, filed Apr. 16, 2010, which is hereby incorporated by reference in its entirety.

TECHNICAL FIELD

The present invention relates to sports equipment, and in particular to high-impact body protecting elements that are used in combination with existing sports equipment, such as sports apparel (e.g., cycling shorts and/or tops), to protect the wearer from impact forces and frictional forces that can result when the wearer unintentionally contacts the ground or another object especially at speeds commonly experiences in activities such as road cycling.

BACKGROUND

As is known, many sports involve a degree of risk and injury and this is especially true for those sports that involve speed and/or contact, e.g., hockey, football, skiing, etc. While many sports include some degree of protective gear, such as helmets or body padding, injuries are unfortunately still common. Even sports, such as cycling or rollerblading, that do not have contact as part of the rules, still involve a degree of risk and expose the participant to injury as is the case when such participant accidentally falls to the ground or is otherwise struck by an object, such as a vehicle or other person.

Rollerblading is one such sport that subjects the user to a higher risk of injury compared to other sports. The increase in the popularity of rollerblading has led to an increase in injuries due to crashes or falls involving the roller bladder. Some of the injuries can be very serious since roller bladders can travel at high speeds and are susceptible to human and vehicle traffic that pass in front of the path of the roller bladder. Roller bladders are also susceptible to foreign debris in the road or uneven or broken pavement that can cause the roller bladder to fall while traveling at a high rate of speed.

Cycling is very common and popular throughout the world in both recreational and competitive landscapes. In many countries, including those in Asia, cycling is a principle means of transportation. Despite its health benefits and environmentally friendly nature, cycling is seen by a number of people to be an inherently high-risk activity although the use of appropriate safety equipment and observing road rules and generally employing "streets smarts and awareness" can reduce the risk of serious injury. Most serious injuries result from a collision between the cycle and an object, such as a car or other motor vehicle, or a stationary object, such as a wall or tree, etc. The concern is heightened for competitive cyclists due to the tremendous speeds that are achieved by such cyclists. Since head trauma is generally very serious or fatal in nature, most states have enacted laws requiring cyclists to wear a helmet. However, the remaining portions of the body are exposed to injury.

Luckily, most bike accidents or falls do not result in serious head injuries but rather result in more minor, yet still very painful, injuries, such as abrasions or even lacerations.

Abrasions are very common sports injuries that are usually caused by a fall on a hard surface. The skin is composed of an outer layer (the epidermis) which provides protection and a deep inner layer (the dermis), which provides the firmness and flexibility of the skin. In dermatology, an abrasion is a wound caused by superficial damage to the skin, no deeper than the epidermis. Mild abrasion (scrapes) do not scar or bleed, but deep abrasions can lead to the formation of scar tissue. An avulsion is a more traumatic type of abrasion that removes all layers of the skin.

Abrasion injuries most commonly occur when exposed skin comes into moving contact with a rough surface (abrasive surface), causing a grinding or rubbing away of the upper layers of the epidermis. With respect to the sports of rollerblading and cycling, as the athlete accidentally falls and/or slides on the ground, friction causes layers of skin to rub off as the body slides or is dragged over the ground. Cyclists often refer to abrasions from crashes as "road rash." While a bike crash has the potential to cause a painful and severe abrasion, most abrasions are shallow scrapes that do not extend into the dermis and do not cause a great deal of bleeding. While there is often little or no blood loss from an abrasion, there can be a tremendous amount of pain because of the many nerve endings that are exposed and often take weeks to heal and can be prone to infection and potential scar formation.

Conventional treatment of abrasions and road rash include the treatment of the affected area by first cleaning the wound with mild soap or applying a mild antiseptic and then covering the area with an antibiotic, such as a spray or cream, before then dressing the wound with suitable bandages and the like.

It is not uncommon to feel stiff and tender while road rash is healing. In addition to the pain and itching associated with the abrasions, the accident which caused the road rash can cause soreness, etc.

While there are some protective gear products that are meant to be worn by a user to protect against fall and impact related injuries, these products have limited applicability to only a handful of sports/activities due to the designs. For example, some roller bladders not only wear a protective helmet but also wear knee and elbow protectors along with wrist protectors. However, many roller bladders find these products to be bulky and they restrict the movement of the wearer. In cycling, conventional biking apparel is not fitted with protective elements that protect against road rash injuries.

In general, for a protective or safety product to be successful, the user (wearer) should not be aware or should only be minimally aware of its existence and presence on the wearer's body.

SUMMARY

The present invention is directed to a human body protecting element for use with and attachment to an article of clothing, such as sports apparel, to protect a wearer from impact and frictional forces, such as road rash. One exemplary body protecting element includes a first part having a first locking member. The first part is for placement along an inner surface of the article of clothing. The body protecting element also includes a second part having a second locking member that is complementary to the first locking member and results in a mechanical coupling (e.g., snap-fit attachment) between the first and second parts when the first and second locking members engage one another. The second part is for placement along an outer surface of the article of clothing and includes an outer ground contacting contoured surface. The ground contacting surface provides a high impact surface that is contoured so that if the wearer contacts and/or slides across the ground, the ground contacting surface protects the wearer by shielding the wearer's body from the abrasive ground surface.

In one embodiment, the first part has a base section and an upstanding wall that extends outwardly from the base section and from which the first locking member depends. The base section further includes a plurality of teeth that are formed on the base section around an exterior surface of the upstanding wall for engagement with the article of clothing to limit movement of the article of clothing between the engaged first and second parts.

The upstanding wall can define a reservoir that can hold a therapeutic agent that can be delivered to the body of the wearer through one or more conduits or the like formed in the first part.

BRIEF DESCRIPTION OF THE DRAWING FIGURES

Figure 7:
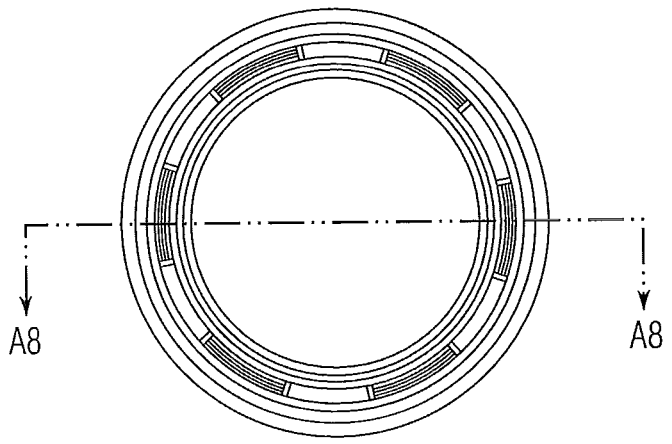
Figure 8:
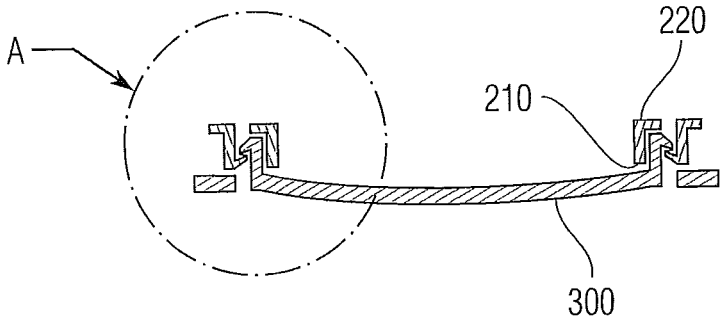
Figure 9:
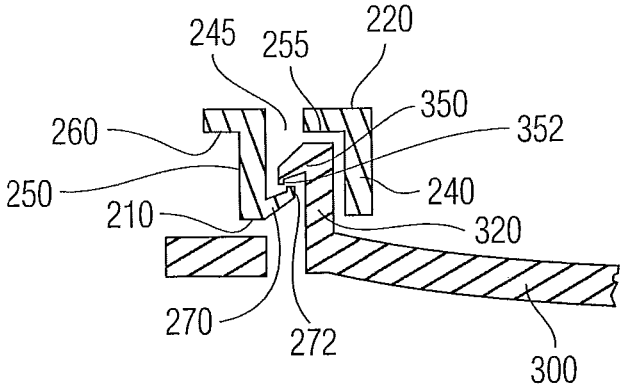
Figure 10:
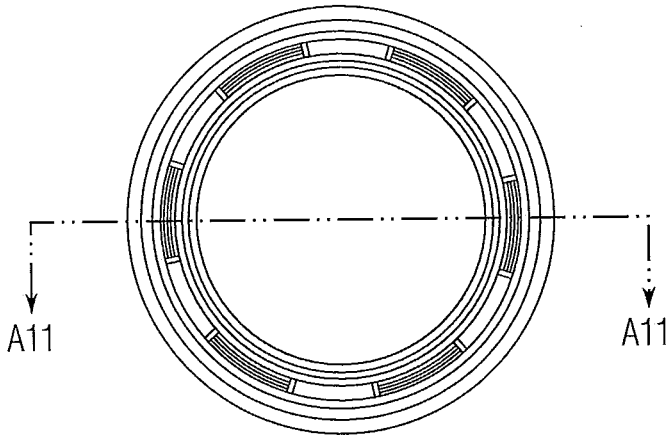
Figure 11:
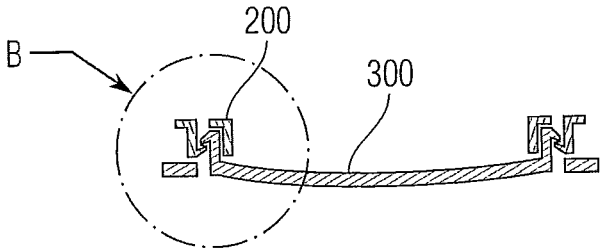
Figure 12:
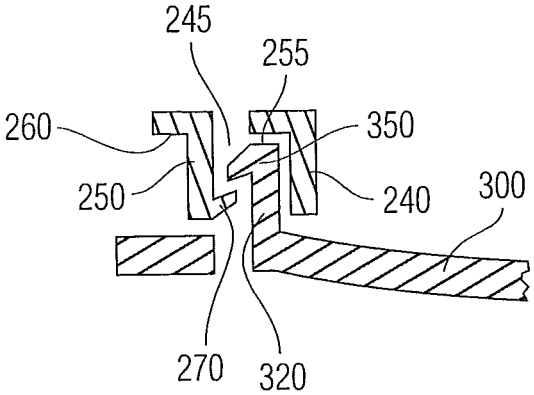
Figure 13:
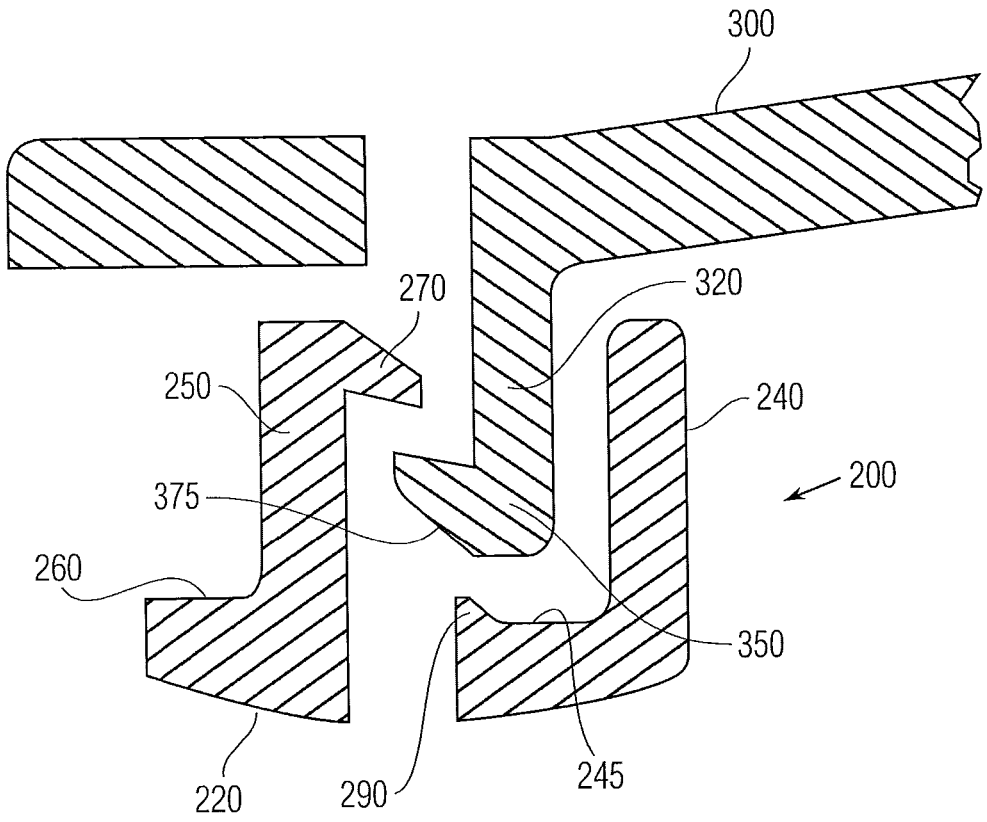
Figure 14:
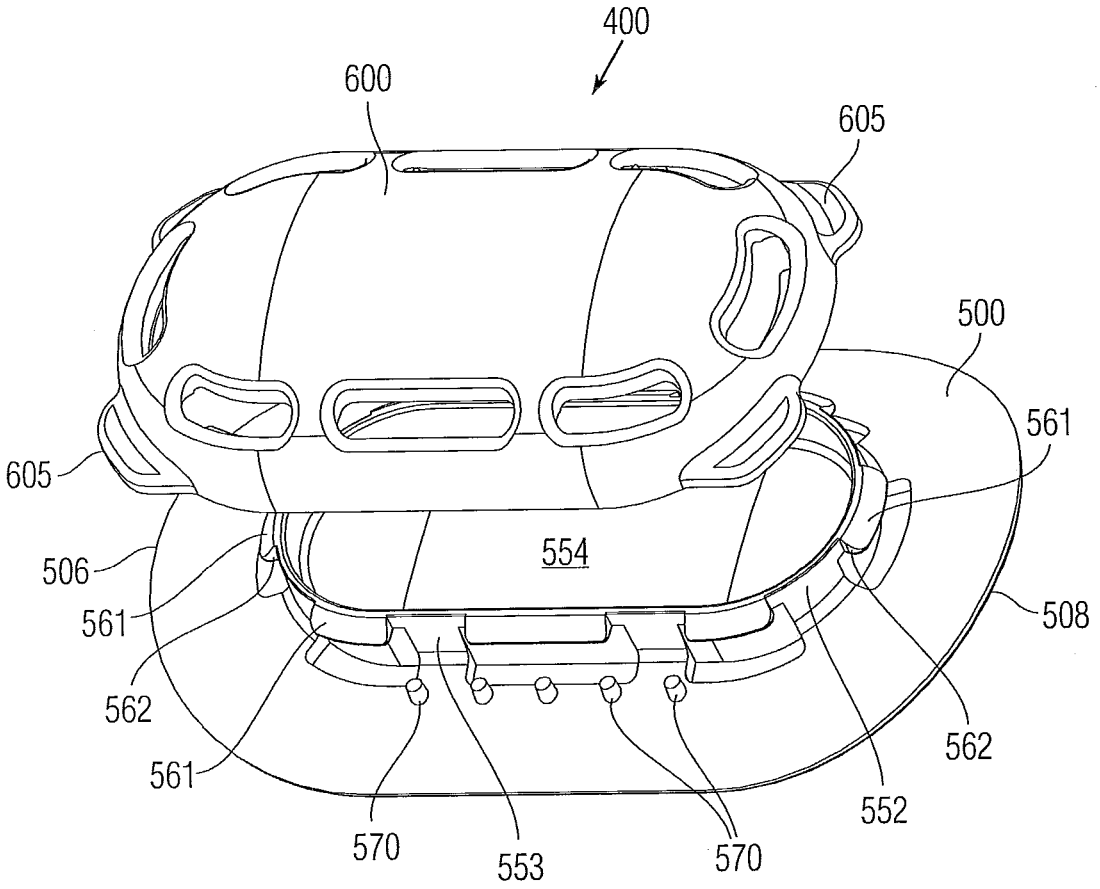
Figure 15:
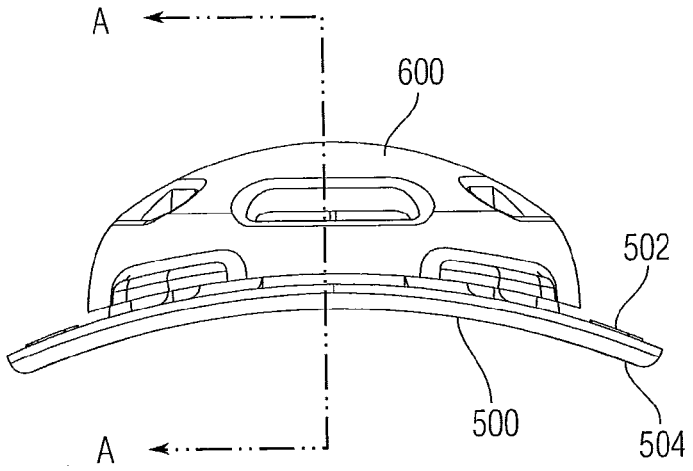
Figure 16:
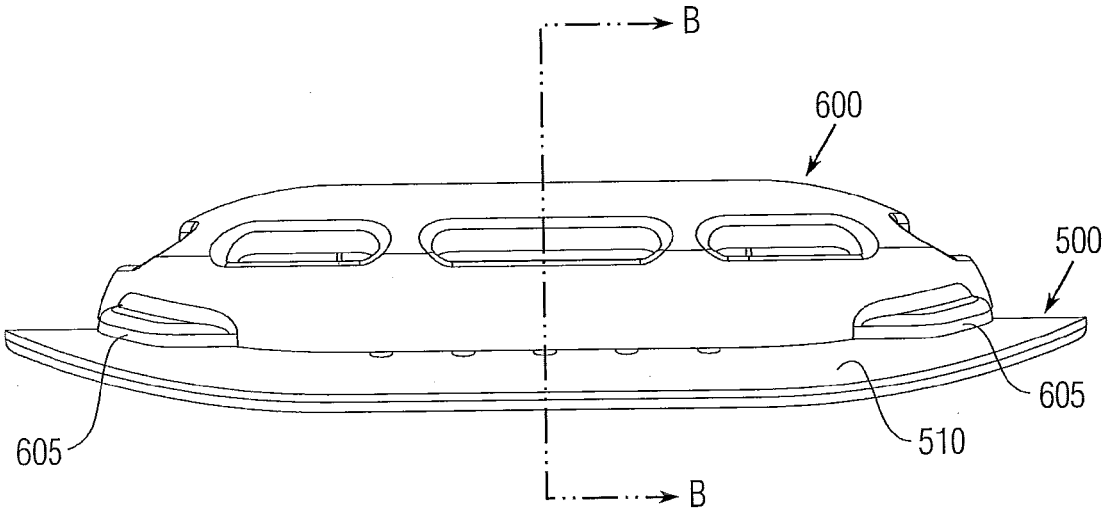
Figure 17:
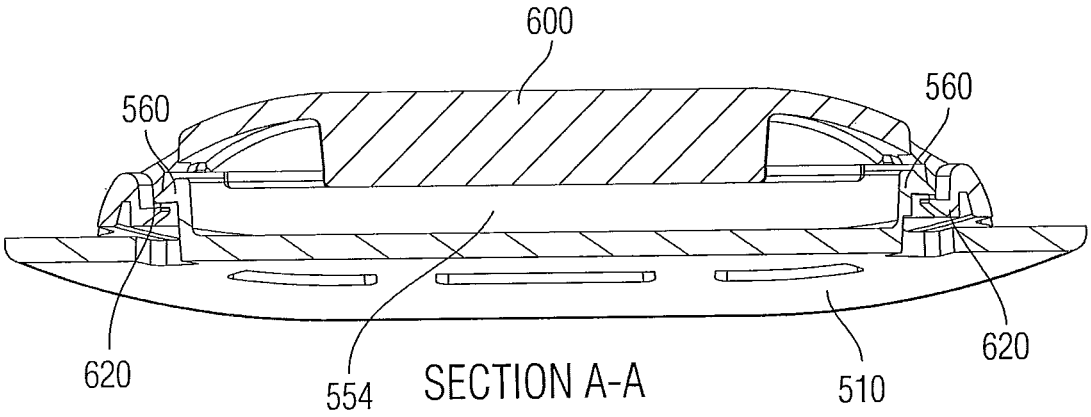
Figure 18:
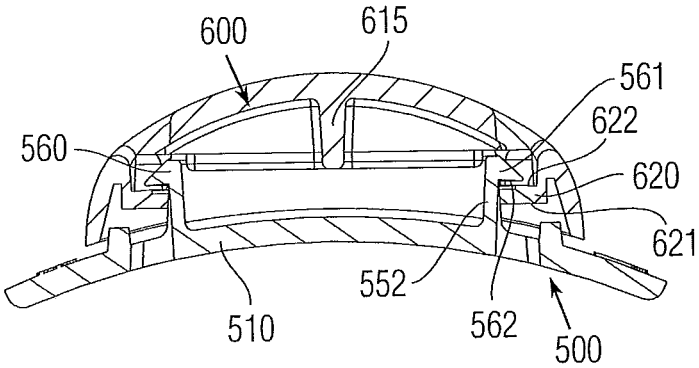
Figure 19:
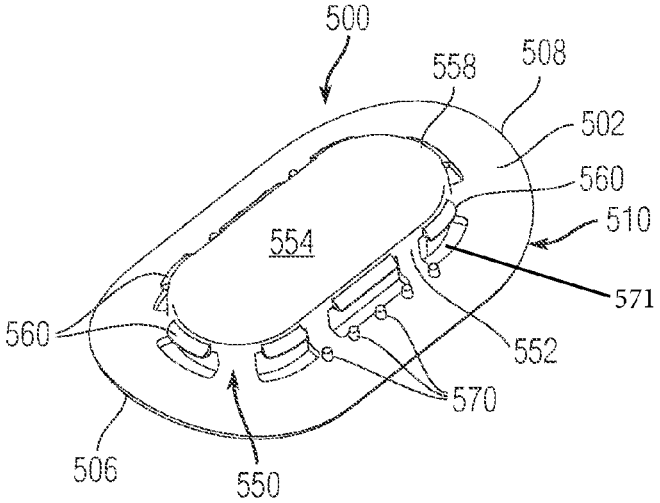
Figure 20:
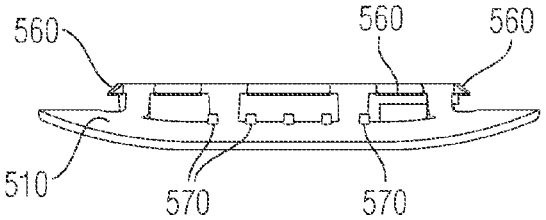
Figure 21:
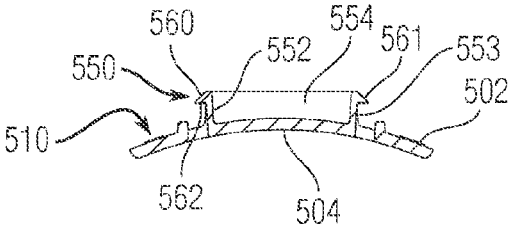
Figure 22:
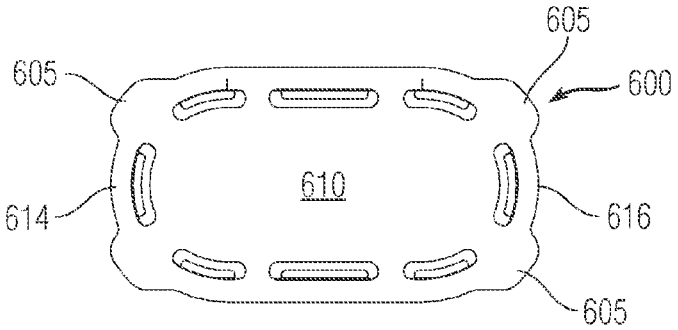
Figure 23:
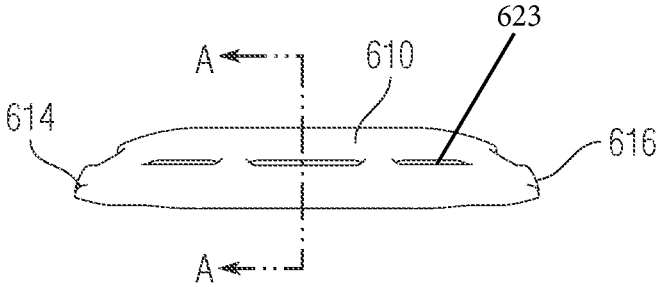
Figure 24:
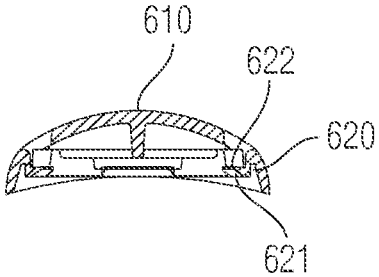
Figure 25:
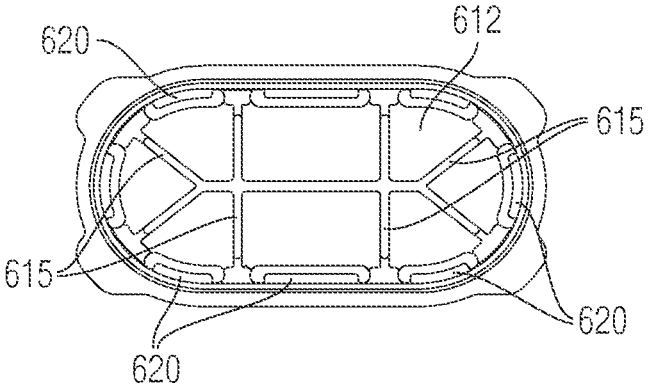
Figure 26:
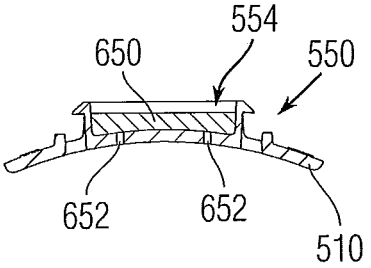
Figure 27:
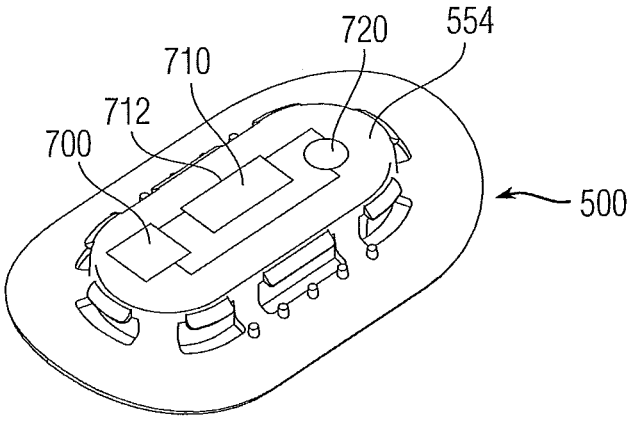

FIG. 7 a top plan view of a body protecting element employing a first type of mechanical attachment between first and second parts of the body protecting element;

FIG. 8 is a cross-sectional view taken along the line 8-8 of FIG. 7;

FIG. 9 is an enlarged cross-sectional view of the first type of mechanical attachment between first and second parts;

FIG. 10 a top plan view of a body protecting element employing a first type of mechanical attachment between first and second parts of the body protecting element;

FIG. 11 is a cross-sectional view taken along the line 11-11 of FIG. 10;

FIG. 12 is an enlarged cross-sectional view of the first type of mechanical attachment between first and second parts;

FIG. 13 is an enlarged cross-sectional view of an exemplary type of mechanical attachment between first and second parts of the body protecting element;

FIG. 14 is a perspective view of a body protecting element according to yet another embodiment of the present invention;

FIG. 15 is an end elevation view of the body protecting element of FIG. 14;

FIG. 16 is a side elevation view of the body protecting element of FIG. 14;

FIG. 17 is a cross-sectional view taken along the line A-A of FIG. 15;

FIG. 18 is a cross-sectional view taken along the line B-B of FIG. 16;

FIG. 19 is a top perspective view of a first part of the body protecting element of FIG. 14;

FIG. 20 is a side elevation view of the first part;

FIG. 21 is a cross-sectional view taken along the lines A-A of FIG. 20;

FIG. 22 is a top plan view of a second part;

FIG. 23 is side elevation view of the second part;

FIG. 24 is a cross-sectional view taken along the line A-A of FIG. 23;

FIG. 25 is a bottom plan view of the second part;

FIG. 26 is a cross-sectional view of a base of a body protecting element that includes a therapeutic agent; and FIG. 27 is a top perspective view of a base of a body protecting element showing an electronic light source.

DETAILED DESCRIPTION OF CERTAIN EMBODIMENTS

It will be appreciated that the body protecting elements (guards) of the present invention can be used as part of clothing or other apparel, such as sports gear or sports apparel that is intended for use with a particular sport and worn by a participant. For purpose of illustration only, the body protecting elements are shown in the form of body protecting elements that are used or intended for use in the sport of cycling; however, the body protecting elements of the present invention can be used in any number of other applications, including other sports, such as rollerblading, etc., where there is a risk of road rash or impact related injuries due to a fall or unintended contact with an object.

Figure 1:
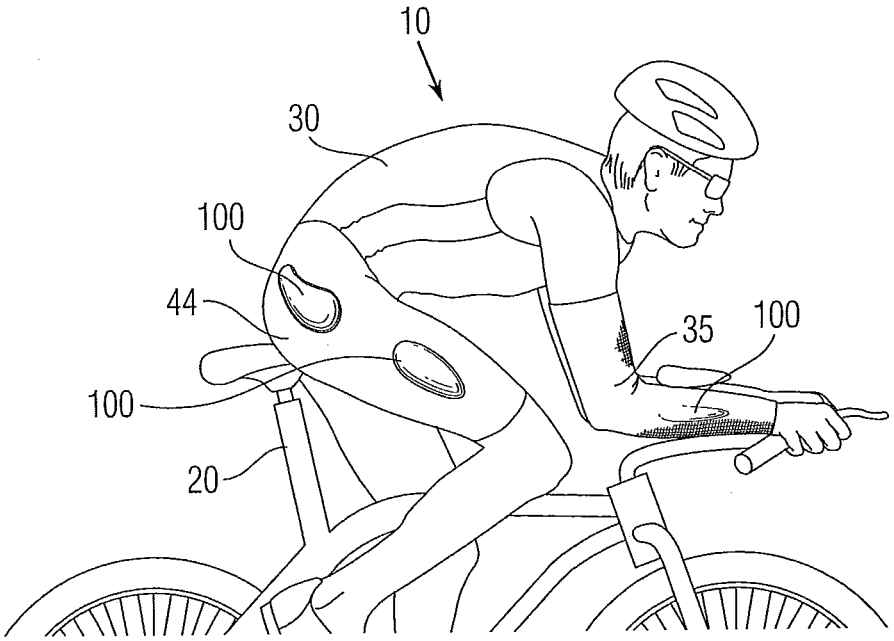
FIG. 1 is a side view of a cyclist riding on a bicycle wearing body protecting elements according to a first embodiment of the present invention.

FIG. 1 is a side view of a cyclist 10 on a bicycle 20 with the cyclist 10 wearing conventional cyclist apparel and protective equipment. More specifically, the cyclist 10 is wearing a jersey 30 (sleeveless) and biking shorts 40 (which can be in the form of standard padded biking shorts or a bib shorts). As with most sports, the apparel should be comfortable and over the recent years, there have been great strides made in the manufacture of technical fabrics that offer superior properties (moisture control, comfort, etc.) and are used in the manufacture of sports apparel (e.g., jerseys, shorts, tights, etc.). It will be appreciated that the products discloses herein can be used with any number of different articles of clothing, including sports apparel as well as conventional clothing, such as cotton shorts and shirts, etc. FIG. 1 also shows another article of clothing that is worn by athletes, including cyclists and runners and in particular, arm warmers 35 are shown. Typically, the fabrics used in today's sports apparel are made of synthetic materials, including spandex fiber, which is a long chain synthetic polymer composed of at least 85% of a segmented polyurethane. In addition a biker typically wears gloves.

FIGS. 1-4 show various human body protecting elements 100 of the present invention attached to the apparel of the cyclist 10. As set forth below and shown in the figures, the body protecting elements 100 can come in any number of different shapes and sizes to allow placement on different locations of the body, including the leg and arm areas. As described herein, the body protecting elements 100 are intended to guard the body against road rash and other injuries related to the wearer's body being subjected to impact forces and/or frictional forces. The body protecting elements are shaped so as to easily glide over an abrasive surface, such as pavement, by virtue of its high-impact, "slippery" (low friction) nature. Since the body protecting elements 100 are in effect worn by the user, the body protecting elements preferably have an aerodynamic shape so as to optimize air flow around the body protecting elements.

When a fall does occur, there are certain areas of the biker's body that are more susceptible to contacting the ground and thus are more prone to being inflicted with road rash. This is generally due to the riding position of the biker; the more common ways in which the cyclist loses control of the bicycle; and due to the more common types of impacts that result between the bicycle and an object, such as a car, other person, etc. Based on the foregoing, the body protecting elements 100 are designed for placement in the areas of the body that are most prone to being subjected to road rash or injured during a fall, etc. The body protecting elements 100 can come in any number of different shapes, colors and sizes (e.g., men's, women's, children, etc.) and can be distributed in a kit that includes a plurality of body protecting elements 100 that are designed for placement in different areas of the body. As described herein, the body protecting elements 100 are constructed to be anatomically contoured in that the elements 100 are configured in view of the anatomical features of the body.

FIG. 1 shows one body protecting element 100 located along the arm warmer 35 of the cyclist in a region that would be susceptible to contacting the ground if a fall or collision did occur. As discussed herein, the means for attaching the body protecting element 100 can be the same whether the body protecting element 100 is attached to shorts 40 or an arm warmer 35.

Figure 3:
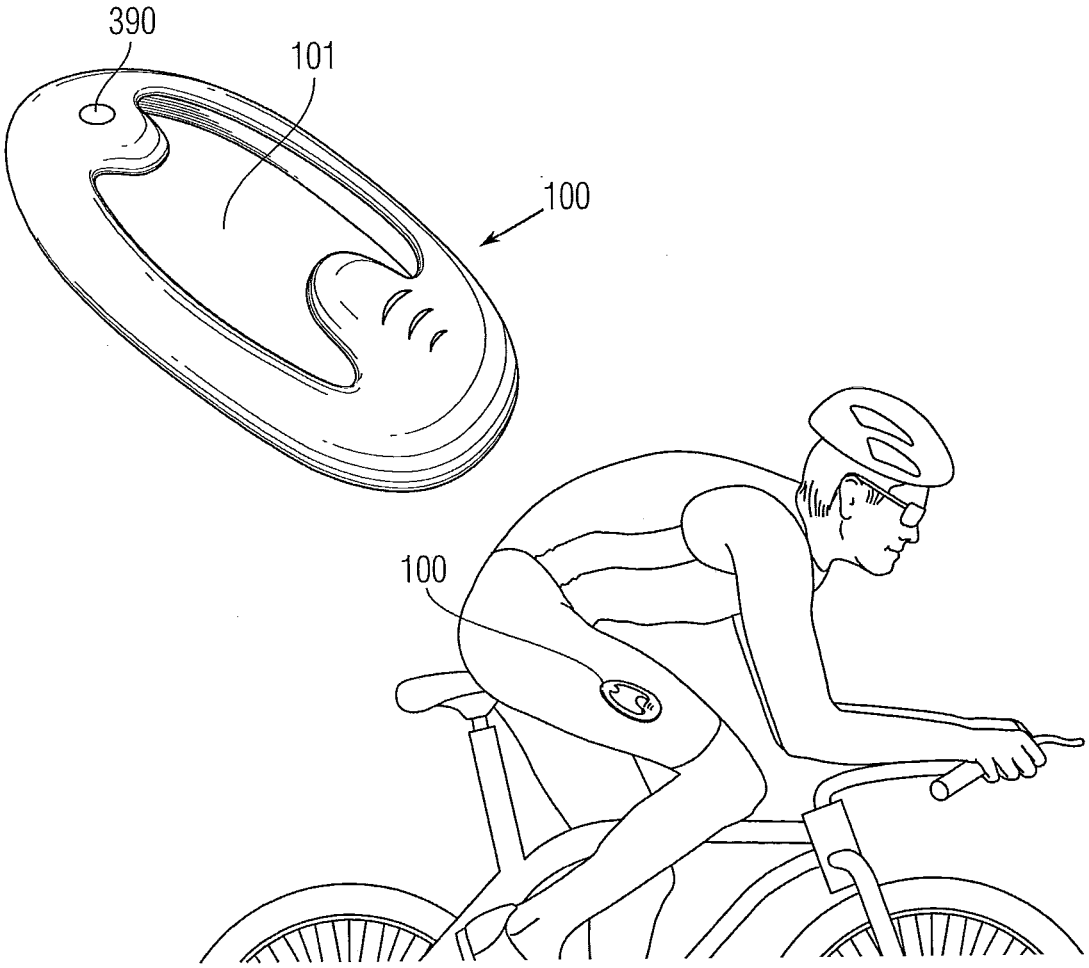
FIG. 3 is a side view of a cyclist riding on a bicycle wearing body protecting elements according to yet another embodiment of the present invention.
Figure 4:
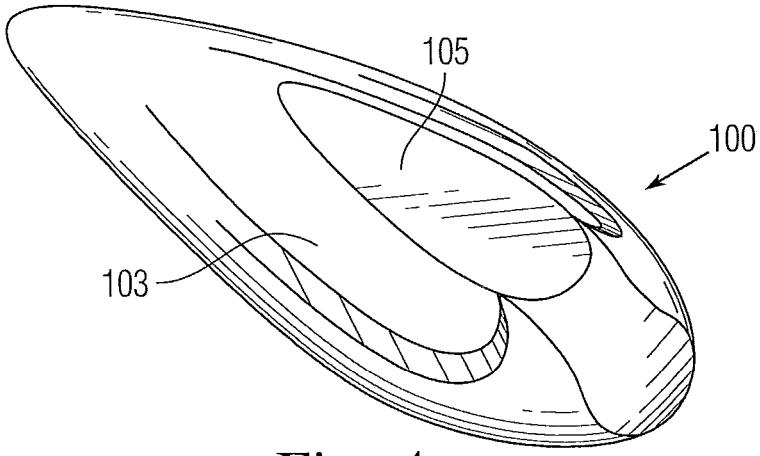
FIG. 4 is a perspective view of a body protecting element according to one embodiment.

FIG. 3 shows a body protecting element 100 according to one embodiment. In this embodiment, the body protector 100 includes a central cut out 101 which results in less material being used for manufacture thereof. The outer surface of the element 100 can be contoured to still provide aerodynamic properties. The high-impact nature of the material used results in a robust element that can withstand the normal impact forces that are experienced in a fall or crash. FIG. 4 shows a body protecting element 100 according to a different embodiment that has an aerodynamic body, including smooth, curved sides 103 and a ground contacting portion 105. The sides 103 can include recessed air flow channels that add to the aerodynamics. The body protecting element 100 of FIG. 4 offers a slippery appearance and is configured to effectively slide along an abrasive surface, such as pavement.

FIGS. 5-13 illustrate body protecting elements (guard) 100 according to different embodiments of the present invention. The body protecting element 100 is intended to be used with sports apparel and is designed to protect the wearer from impact forces and frictional forces that can result from a fall or other type of mishap.

The body protecting element 100 is intended to be removably worn with conventional cycling apparel, such as jersey 40 and biking shorts 40. As described herein, it will be appreciated that the body protecting element 100 can be attached to the sports apparel at any number of different locations, thereby allowing the user to select a location where protection is most desired. The ability for the body protecting element 100 to be worn at multiple different locations along the wearer's body permits each individual wearer (e.g., a cyclist) to customize his or her sports apparel to include a level of protection against road rash or other related injuries.

The illustrated body protecting element 100 is formed of two complementary parts, namely, a first part 200 and a complementary second part 300 that is constructed to engage the first part 200 in a manner in which a mechanical coupling results between the first and second parts 200, 300. For example, a snap-fit type mechanical attachment can be formed between the first and second parts 200, 300 resulting in the parts 200, 300 securely and snap-lockingly mating together. However, as described below, the parts 200, 300 can be released from engagement from one another when desired, such as when the wearer wishes to reposition or place the body protecting element 100 on different apparel. In one embodiment, a tool can be used to disengage the parts 200, 300 and allow removal of the body protector 100 from the apparel and/or repositioning of the body protector 100 on the apparel. However, as described hereinafter, a tool is not required.

The first and second parts 200, 300 are designed to be positioned on opposite surfaces (faces) of the sport apparel, such as the biking shorts 40 shown in FIG. 1. More specifically, the first part 200 is constructed to be disposed along an inner surface of the apparel (e.g., biking shorts 40) and the second part 300 is constructed to be disposed along an outer surface 44 of the apparel. As described herein and shown in the accompanying figures, the apparel (e.g., biking shorts 40) is captured between the first and second parts 200, 300 resulting in the body protecting element 100 being securely attached to the apparel. The apparel is not damaged by the engagement between the first and second parts 200, 300 but rather is securely captured thereby resulting in a secure and fixed attachment of the element 100 to the apparel.

The first part 200 serves as a locking base for the body protecting element 100, while the second part 300 serves as a locking cover as well as serves as the impact receiving (ground-contacting) portion of the body protecting element 100 that protects against road rash by contacting the ground and preventing the wearer's body from making harmful contact with the ground. The first part 200 has an annular shape and includes an upper surface 210 and an opposing lower surface 220 that faces and comes into contact with the wearer's body when the body protector 100 is worn on the apparel. For illustration, the lower surface 220 shown in the figures has a planar shape; however, in one embodiment, the lower surface 220 has a slightly concave shape to allow placement against the wearer's body. Most skin surfaces of the body have some degree of convexity and therefore, an article that is intended to be placed on the skin and into intimate contact with the body should have a bottom surface that has complementary concavity to allow the article to seat flush against the body.

However, as shown in FIG. 1, depending upon the intended placement of the body protecting element 100, the lower surface 220 of each individual body protecting element 100 can be customized and anatomically designed to fit a particular region of the body. In FIG. 1, one body protecting element 100 is located along the quadriceps femoris of the cyclist, while the other body protecting element 100 is generally located along the muscles of the hip joint, which includes the following muscle groups: the gluteal group, the lateral rotator group, the adductor group, and the iliopsoas group. Moreover, depending upon the location where the body protecting element 100 is applied, the overall shape and size of the body protecting element 100 can be customized. For example, the body protecting element 100 can be asymmetrical and can include an arcuate (curved or hook) portion that conforms to the anatomical features of the body. For example, one end of the body protecting element 100 can be a hooked (curved) portion that can face or extend across the gluteal muscle group.

Figure 2:
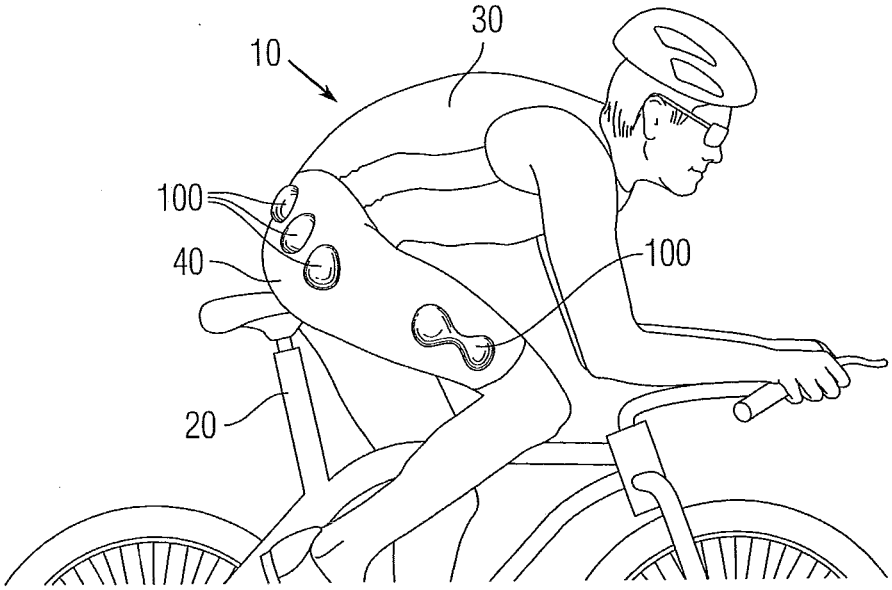
FIG. 2 is a side view of a cyclist riding on a bicycle wearing body protecting elements according to another embodiment of the present invention.

In FIG. 2, the body protecting element 100 that is located along the quadriceps femoris has a dumbbell shape and the body protecting element 100 that is located along the muscles of the hip joint is actually formed of a plurality of individual dome shaped elements that are arranged in a non-linear fashion to offer protection.

It will therefore be appreciated that the lower surface 220 can have an additional layer (not shown) that is intended for placement against the skin. For example, the lower surface 220 can include a fabric or material layer that can be different or similar or identical to the fabric material that forms the sports apparel. This additional layer thus provides a comfort layer for contacting the skin and thereby, the body protecting element 100 does not create an uncomfortable feeling for the wearer. As mentioned above, it is important for the body protecting element 100 to essentially be invisible to the wearer in that the wearer should not be cognizant of its existence against the skin.

For example, this layer can be in the form of a thin block of porous material that permits gas (air) and water (sweat) to pass therethrough. In other words, the layer can breathe. The layer can be in the form of a block of foam or the like that can have an adhesive layer on one face with a removable protective cover. The protective cover is removed to expose the adhesive layer and then the user can simply place the adhesive layer against the lower surface 220. In this way, a layer of foam is placed between the body of the user and the product. It will be appreciated that this type of additional layer of padding can be used with any of the product embodiments disclosed herein. In addition, other types of permeable membranes that offer some additional material between the plastic product and the body can be used. The product can be supplied to the consumer in a package that includes custom cut padded material or breathable layers and the user can have the choice to install such material to the backside of the product. Alternatively, the air permeable film or breathable membrane can be already attached to the base part and can come with a protective cover with a tab to allow the user to peel it off, thus, exposing the adhesive and another tab can be provided of the film or layer itself so as to allow the user to discard the film or layer after use. The user would then apply a new layer or film which can supplied in quantity to the user.

A porous material or fine screen can be added (integrally attached) to the bottom surface of the part 500 by using an overmold process. As is well know, in an overmold process, the plastic body of the part 500 is formed by injecting material into a mold that is adjacent the porous material or screen resulting in an intimate bond being generated between this material and the plastic body of the part 500. The material will provide a comfort layer between the product (base 500) and the body of the user.

As described below, in another aspect of the present invention, a therapeutic agent is incorporated into the body protecting element and in particular, in one embodiment, the therapeutic agent can be incorporated into the material that is disposed between the body protecting element and the body of the wearer. For example, the permeable membranes and padded material discussed above can be constructed to include and hold a quantity of therapeutic agent, discussed below, for controlled delivery to the patient.

Figure 6:
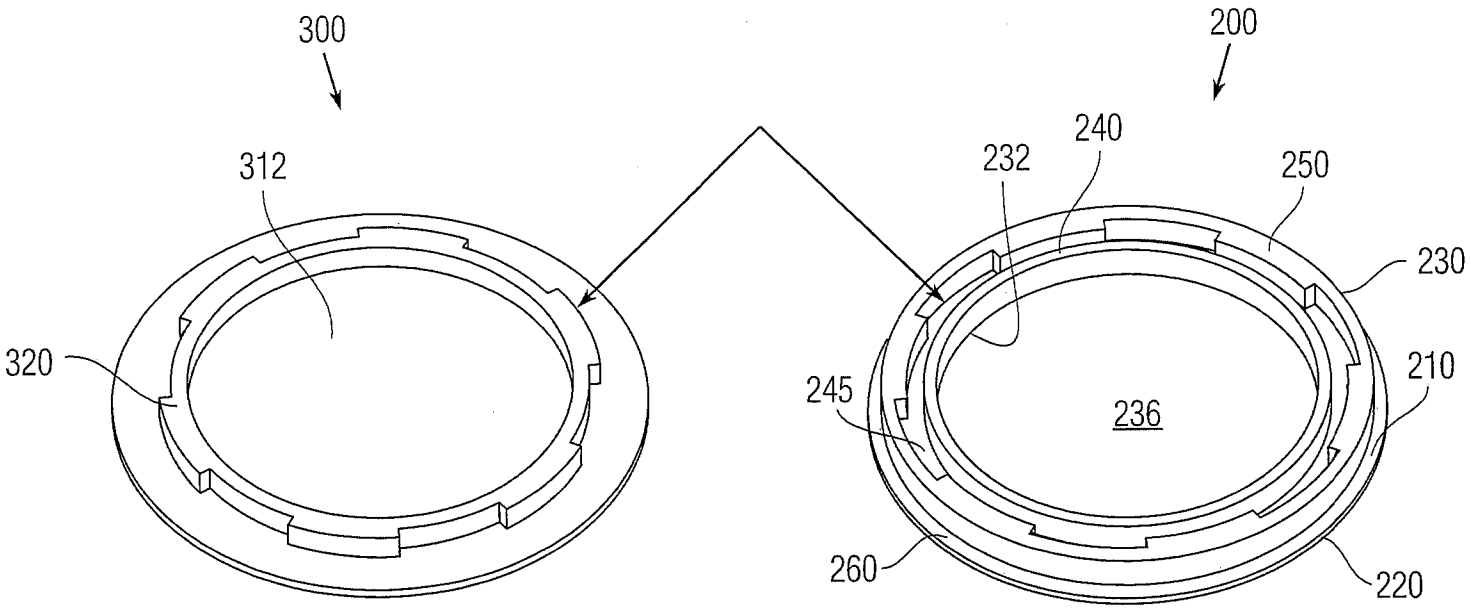
FIG. 6 is an exploded perspective view of the body protector of FIG. 5.

The first part 200 has an outer peripheral edge (circumferential edge) 230 and an inner edge 232 that defines a central opening (e.g., circular shaped opening) 236 formed in the first part 200. The first part 200 has a pair of upstanding walls 240, 250 that are located between the outer and inner edges 230, 232. The first upstanding wall 240 is located at the inner edge 232, while the second upstanding wall 250 is located closer to but slightly spaced from the outer edge 230. The upstanding walls 240, 250 are vertical walls and a space 245 is formed and located between the walls 240, 250 and as best shown in FIGS. 6-7, a floor 255 is formed between the walls 240, 250. As shown in the figures, the floor 255 can include one or more openings or slots (through holes) that simplify creation of tooling for the making the first part 200 using a conventional molding process.

As best shown in FIGS. 8-9, an annular shaped flange 260 extends radially outward from the outer wall 250 and terminates at the outer peripheral edge 230. The lip 260 and floor 255 can lie in the same plane as shown in the figures when the lower surface 220 is planar; however, as mentioned herein, the lower surface 220 can have a concave shape to provide a more anatomically correct surface. The outer wall 250 includes a first locking member 270 for securely coupling the first part 200 and the second part 300. As shown in FIGS. 8-9, the first locking member 270 can be in the form of a first hook member that is formed at the top portion of the outer wall 250 and extends inwardly into the space 245 toward the inner wall 240.

In the embodiment of FIGS. 7-9, the tip of the first hook member 270 includes a catch or the like 272 as opposed to a blunt end.

The first hook member 270 has a degree of resiliency to permit some flexion to provide the mechanical attachment between the first and second parts 200, 300. The first hook member 270 does not have to be continuous about the entire circumference of the outer wall 250. In other words, one or more hook members 270 can be formed about the circumference of the first part 200 at different locations along the outer wall 250. For example, there can be a plurality of circumferentially spaced first hook members 270.

The second part 300 is complementary to the first part 200 and is designed to interlockingly engage (snap-fit) the first part 200. As shown in the figures, the second part 300 has a body that includes a first (outer) surface 310 and an opposing second (inner) surface 312 that faces the first part 200. In the illustrated embodiment, the second part 300 is a disk-shaped member that includes an outer peripheral edge 315.

The second part 300 includes an annular shaped upstanding wall 320 that extends outwardly from the inner surface 312 of the second part 300. The wall 320 is shaped and sized to be received within the space 245 formed between the upstanding walls 240, 250. The wall 320 can be formed at a right angle to the body of the second part 300. At the end of the wall 320, a second locking member 350 is formed. The second locking member 350 is complementary to the first locking member 270 and is designed to mate thereto to form a mechanical attachment between the two parts 200, 300. The second locking member 350 is in the form of a second hook member that is constructed and oriented so that when the first and second parts 200, 300 are mated to one another, the two hook members 270, 350 are brought into contact with another. The second hook member 350 extends radially outward from an exterior surface of the wall 320.

Figure 5:
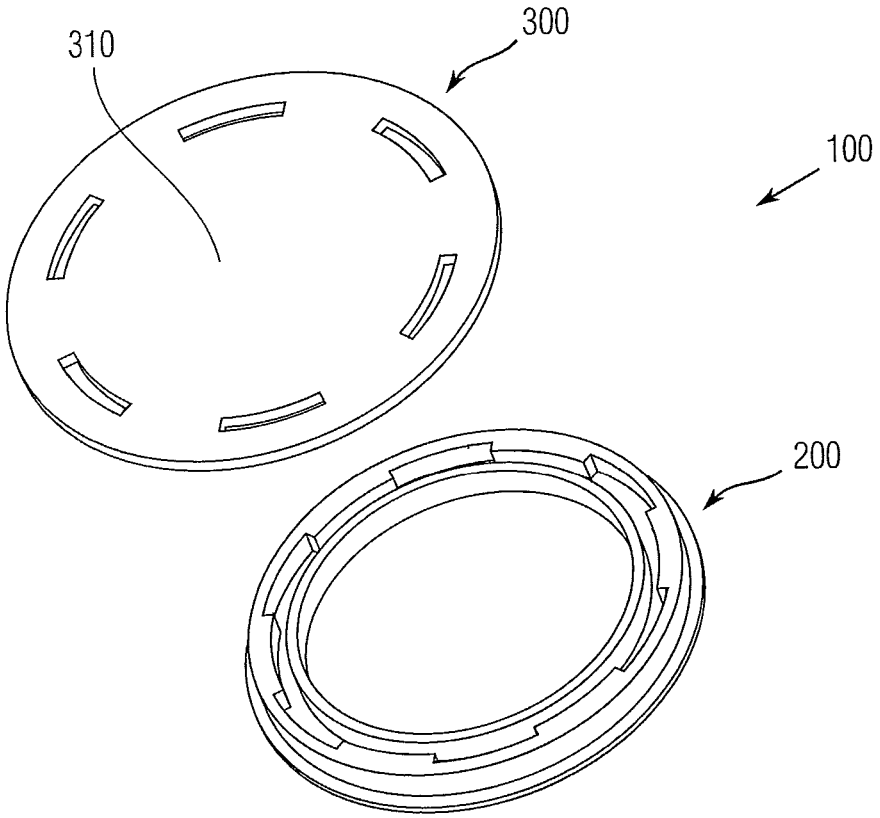
FIG. 5 is an exploded perspective view of the body protecting elements according to one embodiment of the present invention.

It will be appreciated that the outer surface 310 is the ground contacting surface and therefore, the body of the second part 300 can have a dome shape in that the outer surface 310 can have a convex shape. In addition, the inner surface 312 can be a planar surface or it can be a curved surface. FIGS. 5-7 show both the inner surface 312 and outer surface 310 as being curved surfaces.

Similar to the first hook member 270, the tip of the second hook member 350 includes a catch or the like 352 as opposed to a blunt end.

As with the first hook member 270, the second hook member 350 does not have to be a continuous member that extends circumferentially about the wall 320. Instead, one or more hook members 270 can be formed at different locations along the wall 320. For example, there can be a plurality of circumferentially spaced second hook members 350. The number of second hook members 350 should be equal to the number of first hook members 270 to allow pairs of hook members 270, 350 to be defined.

Both the first and second hook members 270, 350 have some degree of flexion and therefore, when the second part 300 is brought into contact with the first part 200 and the second hook member 350 is inserted into the space 245, the second hook member 350 contacts the first hook member 270. Upon contact and further movement of the second hook member 350 within the space 245, one or both of the first and second hook members 270, 350 flexes to permit passage of the second hook member 350 beyond the first hook member 270. Once the second hook member 350 clears the first hook member 270, the first and second hook members 270, 350 return to the normal, rest positions, with the first and second hook members 270, 350 interlockingly engaged to one another, thereby locking the two parts 200, 300 to one another.

In the embodiment of FIGS. 7-9, the two catches 272, 352 associated with the hook members 270, 350 engage one another and limit the degree of movement (e.g., lateral movement) and also ensure that a robust snap-fit joint is formed.

An audible signal and/or tactile signal can result when the two parts 200, 300 mate to one another, thereby indicating to the user that the parts 200, 300 are securely locked to one another. For example, when a snap-fit mechanical attachment is formed, an audible clicking noise is heard when the locking tabs of the two parts mate together, thereby confirming to the user that the two parts are locked in place.

As with the first part 200, the second part 300 can include holes or slots that simplify creation of tooling for the making the second part 300 using a conventional molding process. The width of the through opening is such that the hook member 270, 350 is larger and therefore, cannot fit through the through opening and into contact with the user in the case of the hook member 350.

FIGS. 10-12 illustrate a different embodiment that is similar to the one shown in FIGS. 7-9. In this embodiment, the hook members 270, 350 do not include the catches 272, 352.

FIG. 13 shows another embodiment with a modified snap-fit joint that serves to protect the user (cyclist). The cover 300 is similar or identical to the cover 300 shown in FIGS. 8-10; however, the first part 200 has been modified and is different than the first parts shown in other figures. In particular, the floor 245 between the first and second walls 240, 250 is not planar but instead includes a protrusion (e.g., ridge, rib, ramp, etc.) 290 that is formed therealong at least in locations where the first hook members 270 are formed. In the illustrated embodiment, the first part 200 includes a through opening formed in the floor 245 adjacent one first hook member 270 as shown in FIG. 13. The protrusion 290 is formed on the floor 245 adjacent this through opening spaced from the first hook member 270. The protrusion 290 is in the form of an inclined ramp that has an incline that terminates at the through opening.

The protrusion 290 is beveled and strategically located to act as a cam surface for driving the second hook member 350 into contact with the first hook member 270 to effectuate a snap-fit therebetween. The angle and location of the protrusion 290 helps directs the inserted second hook member 350 into contact with the first hook member 270. In addition, a beveled edge 375 of the hook member 350 is complementary to the shape and incline of the protrusion 290 to assist in directing the two hook members 270, 350 to one another.

It will also be appreciated that the surface 220 of the first part 200 shown in FIG. 13 is not planar as in the other figures but has a curved profile. In the illustrated embodiment, the surface 220 has a concave profile.

It will also be appreciated that the diameter of the second (cover) part 300 can be different (i.e., greater) than the diameter of the first (base) part 200 so as to form a cover that extends radially outward beyond the base.

The means for attaching the body protecting element 100 to the sports apparel that is shown in FIGS. 5-13 is merely one exemplary way of attaching the body protecting element 100 to the apparel in a secure yet removable manner so as to permit repositioning, etc. It will be appreciated that each of the body protecting elements 100 shown in FIGS. 1-2 can have more than point of attachment to the apparel. In other words, the second part (cover) 320 can have a plurality of annular walls 320, each of which has its own second hook members 350, that are spaced apart from one another. For example, the dumbbell shaped cover 300 shown in FIG. 2 can have two annular locking walls 320 that are located in the two lobes of the dumbbell and is attached to the apparel by using two bases (first parts) 200 that are placed along the inner surface of the apparel. The two first parts 200 are snap-fittingly mated to the two pairs of locking members 350 that are associated with the second part 300. Similarly, other body protecting elements 100 can have more than one point of attachment to the apparel by incorporating more than one means for attaching or anchoring the element 100 to the apparel (e.g. the snap-fit elements described herein).

Since the body protecting element 100 can be removed from the sports apparel, the two parts 200, 300 are designed with this object in mind. For example, a tool (not shown) can be provided for removing the cover portion (second part 300) from the base portion (first part 200) that underlies the apparel. The tool can have a handle and a contoured surface, such as a beveled surface or the like, that upon insertion between the first and second locking members 270, 350, causes disengagement of the two locking members 270, 350, thereby freeing the cover portion and allowing removal or repositioning of the body protecting element 100.

In addition, disengagement of the two parts 200, 300 can be performed by rotating the cover portion (part 300) relative to the base portion (part 200) to cause the locking members 350 to contact and ride up cam surfaces that are part of the base portion. This action causes the locking members 350 to separate from the locking members 270, thereby unlocking the two parts 200, 300.

The body protecting element 100 is also sized so that it occupies a sufficient area of the apparel so that if a fall does result, the body protecting element 100 not only makes first contact with the ground but also, provides a ground contacting surface of a sufficient area that as the portion of the body slides along the ground, the body protecting element 100 supports and spaces the wearer's body from the ground.

Any number of different materials can be used to make the first and second parts 200, 300 so long as the materials provide the desired properties and in particular, the material used to make the second part 300 must be a high-impact material that can withstand forces generated thereagainst and can withstand contacting the ground at a high rate of speed and sliding across the ground at a high rate of speed. One suitable material for making the second part 300 is a high impact acrylonitrile butadiene styrene (ABS), while the first part 200 can be formed of a lower impact material, such as a polypropylene (PP) co-polymer. However, other materials, such as polyurethane, are equally possible. In addition, one particularly useful material is a polycarbonate resin thermoplastic (e.g., commercially available under the tradename "Lexan").

The body protecting element 100 is thus formed of a light weight material and is aerodynamically designed so as to impart to the user the idea that body protecting element 100 is not impeding the cyclist's performance. The body protecting element 100 can also incorporate other safety features as by being made to have reflective or glow-in-the-dark properties. For example, the material that is used to form the second part 300 (the cover or cap) can be formed of an injection moldable thermoplastic that has reflective properties and therefore, when car headlights illuminate the cover 300, it illuminates or creates enough reflectance so that the driver sees the wearer of the present product. It will be appreciated that any of the outer parts (caps or covers) disclosed herein can be manufactured using this type of material.

In addition, while the cover portion (second part 300) has been described as being formed of a homogenous material, it will be appreciated that the cover portion can be formed of more than one material. For example, the ground contacting portion (outer surface) of the second part 300 can be formed not only of a high impact plastic but it can also incorporate an energy absorbing material that still offers the necessary protection against road rash and does not degrade when subjected to road rash conditions. In addition, a layer can be added to the exterior, exposed surfaces of the cap 600 to reduce friction that results between the cap 600 and the ground surface. For example, a low friction material, such as Teflon, can be added to the exterior surface of the part (cover) 600. The low friction material can be added using any number of conventional techniques (e.g., a spray coating process) and is performed after the body of the part 600 is formed.

It yet another aspect, it will be appreciated that the body protecting element 100 can include an integral safety feature in the form of an actuatable safety light, such as an LED light 395 shown in FIG. 3. The light can be incorporated into the cover portion (second part 300) along an outer surface thereof so as to externally visible when actuated. The light can operate either in a continuous mode or a blinking mode. The light 395 will include a small PCB that is operatively connected to the LED, a power source (battery) and a switch. The switch can be a simple on/off button can be present along the outer surface of the second part 300. This button or an additional button can be used to switch to the preferred operational mode. The light (LED) can be disposed within a recessed opening in the second part 300 so that if the outer surface of the second part 300 contacts the ground, the light is not placed into direct contact with the ground.

In addition, it will be appreciated that the first part 200 of the body protecting element 100 can be integrally incorporated into the apparel. In other words, sports apparel can be manufactured so as to already include the first part 200 in which case the first part 200 is not entirely underneath the article of clothing but instead, the locking portion (e.g., the upstanding walls 240, 250 and the locking member 270) of the first part 200 are exposed along the article of clothing. Conventional garment forming techniques can be used to manufacture the apparel with the first parts 200 integrally attached thereto. To form the body protecting element 100, the user simply snap-fittingly mates the second part 300 to the first part 200 as described herein.

Now turning to FIGS. 14-24 in which a body protecting element 400 according to another embodiment of the present invention. The body protecting element 400 is similar to the other embodiments and includes a first part 500 and a second part 600. The first part 500 can be thought of as a base and represents the part of the body protecting element 400 that is disposed within the garment (clothing) proximate the body of the user. The second part 600 can be thought of as a cap or cover and represents the part that is disposed on the outside of the garment (clothing). As with the other embodiments, a secure, yet releasable, mechanical attachment results between the first and second parts 500, 600. For example and as described below in more detail, a snap-fit can be formed between the first and second parts 500, 600.

FIGS. 19-21 show the first part 500 (base). The first part 500 is preferably an integral structure, such as a molded plastic part, and includes a first face or surface 502, an opposing second face or surface 504, a first end 506, and a second end 508. The first part 500 includes a base section 510 and an upstanding section 550. The illustrated base section 510 has a curved shape with the second face 504 (bottom surface) being concave shaped and the first face 502 (top surface) being a convex shape. The upstanding section 550 extends upwardly from the first face 502 of the base section 510. The upstanding section 550 can be formed by an upstanding continuous wall 552. For example, in the illustrated embodiment, the wall 552 has an oval shape; however, any number of shapes are possible. The upstanding wall 552 defines a hollow space 554 that can be thought of as a reservoir or well in some embodiment. The space 554 thus includes a floor (that can be curved in shape due to the curvature of the base section 510). The upstanding wall 552 can be formed at a right angle relative to the base section 510.

The upstanding wall 552 includes an exterior surface 553 that faces the peripheral edges of the base section 510. Along the upstanding wall 552, one or more locking tabs 560 extend outwardly therefrom. The locking tabs 560 extend radially outward from the exterior surface 553 and are located at the top edge of the upstanding wall 552. The locking tab 560 includes a beveled edge (cam surface) 561 that terminates at an undercut edge 562 (formed at a right angle) and thus, the locking tab 560 represents a catch that can engage a complementary member. The locking tab 560 can generally be in the form of a hook.

In the illustrated embodiment, the upstanding wall 552 has curved ends 558 and there can be one or more locking tabs 560 at the curved ends 558. The locking tabs 560 thus are formed along the sides of the upstanding wall 552 and at the curved ends 558.

The base section 510 can include a plurality of garment engaging members 570 that assist in establishing a securing gripping action between the body protecting element 400 and the garment to which the body protecting element 400 is attached. In the illustrated embodiment, the members 570 can be in the form of a plurality of teeth or sharpened protrusions that intimately engage the garment when contact is made therewith. The members 570 can be a series of teeth that are formed linearly along the top surface of the base section 510 alongside the upstanding wall 552 and as illustrated, there can be two rows of teeth 570, one alongside each side of the upstanding wall 552. As shown in FIG. 19, the first part 500 includes a plurality of openings 571 that are formed between the locking tabs 560 and the members 570.

The teeth 570 can have any number of different shapes, including pyramidal, cylindrical, etc., so long as the top portion has a sharpened tip to engage the garment without damaging the garment.

Since the first part 500 is worn in close proximity to the body, it preferably does not have sharp edges and therefore, the base section 510 is devoid of any sharp edges but instead has smooth curved edges as illustrated.

As described herein, in some embodiments, the space 554 functions as a reservoir or well that can receive one or more items.

FIGS. 22-25 show the second part 600 that is intended to be securely, yet releasably, attached to the first part 500. The second part 600 is thus the part that first receives an impact force as when the person falls due to its location on the exterior of the garment. Like the first part 500, the second part 600 is preferably formed as a single molded plastic part.

In the illustrated embodiment, the second part 600 has a size that is less than the size of the first part 500 since the first part 500 is designed to be attached along the top surface of the first part 500. As mentioned herein, the second part 600 represents a cap or cover that mates with the first part 500. The second part 600 has a first (top) surface or face 610 (an outer ground contacting contoured surface), a second (bottom) surface or face 612, a first end 614 and an opposing second end 616.

The second part 600 is also at least partially hollow in that it has an arcuate shape like the first part 500 as best shown in FIG. 24. The second part 600 thus represents a dome-shaped structure.

Along the body of the second part 600 proximate the bottom face 612, the part 600 includes locking tabs 620 that are complementary to the locking tabs 560 and designed to engage therewith to provide a secure attachment between the two parts 500, 600. The number, size and location of the locking tabs 620 is thus complementary to the tabs 560 to allow the two parts 500, 600 to intimately mate together.

The locking tab 620 includes a beveled edge (cam surface) 621 that terminates in an undercut edge 622 (formed at a right angle) and thus, the locking tab 620 represents a catch that can engage a complementary member, in this case locking tab 560. The locking tab 560 can generally be in the form of a hook.

In the illustrated embodiment, the body of the second part 600 has curved ends 614, 616 and the locking tabs 620 are disposed about the body including at the curved ends 614, 616.

In one embodiment, as illustrated, the second part 600 is not completely oval shape but instead, there are a plurality of spaced outwardly extending tabs 605 that are designed to provide a means for the user to remove and disengage the second part 600 from the first part 500 after use. For example, there can be tabs 605 formed in the corners of the second part 600. As described below, when the second part 600 is mated to the first part 500, a user can get a fingertip underneath one tab 605 to apply a lifting force to disengage the mechanical fit between the two parts 500, 600.

As shown in FIG. 25, the bottom face 612 can include a plurality of structural reinforcing ribs 615 that serve to reinforce the second part 600 since the second part 600 is the part of the device that receives an impact force. The reinforcing ribs 615 extend along the length and width of the second part 600.

In the illustrated embodiment (see FIGS. 23-25), the second part 600 includes a top section 617 (e.g., convex section) that is joined to an annular shaped base section 619 by means of a plurality of interconnecting walls (spokes) 621. The reinforcing ribs 615 are found on the underside of the top section 617 and extend between the spokes 621. Openings 623 are formed between the top section 617 and the base section 619.

The top surface 610 of the second part 600 can include one or more protrusions formed therealong. For example, the top surface 610 can include a plurality of hemi-spherical shaped protrusions. The protrusions serve as ground contacting elements.

The assembly of the first and second parts 500, 600 is now described with reference to FIGS. 14-18. As in the other embodiments, the first part 500 is positioned underneath an article of clothing with the bottom surface 504 facing the body of the wearer and the top surface 502 facing the article of clothing. The first part 500 is placed in a strategic location where protection from a fall is desired. The second part 600 is then placed on the other side (exterior surface) of the article of clothing and is aligned with the first part 500 so as to position the first end 614 near the first end 506 and the second end 616 near the second end 508 as shown in FIG. 14.

The second part 600 (cap or cover) is then mated with the first part 500 by engaging the locking tabs 620 with the locking tabs 560. This is best shown in FIGS. 17 and 18. As the second part 600 is seated with the first part 500, the locking tabs 620 ride along the cam surfaces 561 of the locking tabs 560 and in particular, the two cam surfaces 621, 561 initially seat against each other causing some outward flexing of the tabs 620 which is permitted since the tabs 620 are resiliently formed. Continued movement of the second part 600 towards the first part 500 causes the locking tabs 620 to clear the locking tabs 560 at such time, the resilient nature of the locking tabs 620 causes the tabs 620 to flex back inwardly, thereby seating the two undercut edges 622 and the 562 to one another as shown in FIGS. 17 and 18.

An audible noise, such as a clicking noise, is heard when the locking tabs 560, 620 seat together. This provides audible confirmation that the two parts 500, 600 are securely seated to one another.

In the secured (assembled) position, the article of clothing is captured between the two parts 500, 600 and the teeth 570 engage the article of clothing and prevent inadvertent disengagement of the second part 600 from the first part 500 due to normal movement of the article of clothing during exercise. The teeth 570 in effect "bite" into the article of clothing without causing any damage thereto and prevent lateral movement of the article of clothing that is captured between the two parts 500, 600.

Similar to the other embodiments disclosed herein, the body protecting element 400 offers an easy to assemble product that provides protection from accidental falls and the like while performing sports, etc.

In yet another embodiment shown in FIG. 26, the body protecting element 400 can be modified so as to carry a medicinal or therapeutic agent 650 within the reservoir 554 for controlled delivery to the user. The base 510 includes openings (ports, channels, etc.) 652 that are in communication with the reservoir 554 at one end and are open at the other end along the bottom surface of the first part 500 for delivery of the agent to the body of the user/wearer. There can be a plurality of openings or conduits 652 formed along the floor of the reservoir 554 in spaced fashion so that the agent can be delivered to more than one location of the user's body.

The agent 650 can come in any number of different forms, including a liquid, a gel, a solid, etc. A protective cover, such as a plastic sheet or layer, can be disposed over the open top of the reservoir 554 to contain the agent therein. It will also be understood that especially in the case where the agent is a liquid, a membrane (not shown) can be disposed across the openings to allow selective and controlled movement of the agent therethrough so as to control release of the agent to the body. The release mechanism of the agent can be any number of known release mechanisms, including diffusion, etc.

In addition, the upstanding wall 552 is preferably a solid, continuous structure to provide maximum strength; however, openings can be formed in the base section 510 around and at the base of the upstanding wall 552.

It will be appreciated that the agent can be a natural product, such as a herbal based agent, or it can be a pharmaceutical drug, such as an anti-inflamatory drug. It will be appreciated that any number of different agents can be used depending upon the precise needs of the wearer. It is also envisioned that nutrients and minerals can included as part of the agent and therefore, can be slowly introduced to the wearer over time which is potentially beneficial over a long race.

In this embodiment, a means for dispensing or eluting a medicine or herbal-based product on a time-release basis. The objective of this device is to relieve the user from muscular or joint pain while exercising and not after when most of the pain or discomfort is felt. An example of a well known herbal-based product that can be dispensed is Arnica.

In yet another embodiment shown in FIG. 27, the reservoir 554 can contain electronics that are used to provide a light source within the body protecting element 400. For example, the reservoir can contain a power source 700, such as a battery, a controller 710, such as a printed circuit board, and a light source or unit 720, such as an LED. The controller 710 also includes an actuator, such as a switch 712 that permits the user to at least turn the light source 720 on and off and optionally allows the user to select different operating modes, such as continuous illumination or blinking, etc. The light is emitted through the cover (second part 600) away from the user. Thus, the second part 600 can include a number of openings or slots that allow the emitted light to be seen. In addition, the second part 600 includes openings or slots 623 that permit light to pass therethrough.

In addition, the first part 500 can incorporate a light sensor (eye) that is operatively connected to the controller 710 and is constructed so that when the sensed light reaches a certain level (e.g., dusk), a signal is generated and the light source 720 is automatically activated. Conversely, when the sensed light reaches an elevated level (e.g., daylight), the light is turned off automatically.

Not only can the product with LED be worn as described herein but also it can be attached to a bicycle using a strap.

In yet another aspect, a tool (not shown) can be presented to assist in disengaging the second part 600 from the first part 500. For example, a small flexible plastic card, similar to a grocery award program card, can be provided and include an opening to allow it to be hung on a keychain or necklace. One edge of the card can be disposed between the two parts 500, 600 and an upward lifting force is generated to separate the two parts 500, 600.

It will be understood that the body protecting elements of the present invention can have any number of different shapes and are not limited to the illustrated shapes. For example, the body protecting element can be more elongated and oblong or can even have a polygonal shape or be X-shaped or have any other shape that permit two parts to be mated together to form a mechanical attachment. Depending upon the location where the body protecting element is to be used, the body protecting element can come in different sizes, including larger sizes for areas such as the hip, etc.

Optionally, the outer surface (top surface) of the second part 600 can be formed of two materials and in particular, a metal component can be added to an underlying plastic component. For example, the second part 600 can be formed of metal dome that includes locking tabs 620 and mates with a plastic first part 500 as described herein by engaging the locking tabs 560, 620. Alternatively, the second part 600 can be aplastic part and metal protrusions (e.g., dome shaped protrusions) can be provided along the top surface thereof as by molding the plastic part 600 around the metal protrusions in a common molding process.

The body protecting element also has great versatility in that it has been subjected to conventional cloths washing and drying cycles and has remained in place in a locked position relative to the article of clothing and was not damaged in any way. In addition, for strength testing, the body protecting element was subjected to the weight of a vehicle (e.g., a vehicle drove over the body protecting element) and the product withstood the impact and weight and was not damaged.

It will be understood that the present invention is directed to providing anatomically based body protecting elements that are intended to prevent road rash type injuries and are constructed to be easily attached to existing sports apparel, such as biking shorts. The body protecting elements described and shown herein are merely exemplary in nature and are not limiting of the present invention since other attachment means can be used to effectuate the attachment of the element to the apparel. In addition, the different parts described herein can have different constructions so long as they perform the function described herein and protect against road rash.

The present invention broadly covers providing a body protecting element formed of two parts that are positioned on opposite sides of the article of apparel and intimately engage one another so as to capture the article of apparel therebetween.

As previously mentioned, the body protecting elements disclosed herein are designed so that the wearer is either not aware or only minimally aware of its existence and presence on the wearer's body. This can be understood in terms of an individual's specific gravity and in particular, an average man has a weight of 76 kg or 76,000 g and a specific gravity of between 1.01 g/ml and 1.06 g/ml. In one example, the product shown in FIG. 14 has a total weight of less than 10 grams and in particular the base portion 500 has a weight of about 4.34 g and the cap/cover 600 has a weight of about 3.51 g. It will therefore, be appreciated that the present product is only a fraction of the weight of the person and therefore, its presence is only minimally felt if at all.

It will also be appreciated that the body protecting elements disclosed herein are not limited to only being used with conventional articles of clothing, such as jerseys and shorts, etc. In addition, the body protecting elements can be used with other sports equipment worn by an individual. For example, the product can be used with arm warmers, gloves, knee-high socks, etc. The product is used in the same manner described herein in that one part of the product is disposed along the interior of the equipment and the other part is disposed on the opposite side and mates thereto so as to capture the equipment therebetween. In the case of gloves, the body protecting elements can be disposed along the palm side of the hand or along the outer side of the hand or both.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

We claim:

1. A human body protecting element for use with and attachment to an article of clothing to protect a wearer from impact and frictional forces comprising:

a first part having an integral first locking member, the first part having a bottom surface for placement along an inner surface of the article of clothing; and a second part having an integral second locking member that is complementary to the first locking member and results in an interlocking between the first and second parts when the first and second locking members engage one another, the second part for placement along an outer surface of the article of clothing and includes an outer ground contacting contoured surface, wherein the article of clothing is captured between the first and second locking members;

wherein the first part has a base section that defines the bottom surface and an upstanding wall that extends upwardly from the base section and from which the first locking member depends, the upstanding wall having an exterior surface, the exterior surface of the upstanding wall being inwardly spaced from a peripheral edge of the base section, the upstanding wall defining a hollow space that has an open top and is defined by a floor which comprises a portion of the base section and extends between the upstanding wall, wherein the second part has a top surface which serves as ceiling and covers the open top of the hollow space when the first and second parts are coupled to one another and the second part seats against a free end of the upstanding wall;

wherein the first part comprises a first single part and the second part comprises a second single part;

wherein the first and second parts comprise an unlocked configuration and a locked configuration, wherein in the unlocked configuration, the first and second parts are detached from one another and the first locking member is integral to the first part and wherein in the locked configuration, the first and second parts are interlocked to one another and the first part completely surrounds a peripheral edge of the second part.

2. The body protecting element of claim 1, wherein the article of clothing comprises sports apparel.

3. The body protecting element of claim 1, wherein at least one portion of the ground contacting contoured surface has a convex shape.

4. The body protecting element of claim 1, wherein the mechanical coupling between the first and second parts comprises a snap-fit attachment.

5. The body protecting element of claim 1, wherein the base section further includes a plurality of teeth that are formed on the base section around the exterior surface of the upstanding wall for engagement with the article of clothing to limit movement of the article of clothing between the engaged first and second parts in said locked configuration.

6. The body protecting element of claim 5, wherein there are a plurality of spaced first locking members formed at top edges of the upstanding wall and the second part includes a plurality of spaced second locking members.

7. The body protecting element of claim 5, further including a power source, a controller and a light source that are disposed in the hollow space and are disposed such that the power source, the controller and the light source can be seen through the second part for providing safety illumination.

8. The body protecting element of claim 7, wherein the second part includes openings that permit light to pass therethrough.

9. The body protecting element of claim 1, wherein the first locking member includes a cam surface that terminates in a first undercut wall and the second locking member includes a cam surface that terminates in a second undercut wall, wherein when the first and second parts are mechanically coupled to one another, the two undercut walls seat flush against each other in said locked configuration.

10. The body protecting element of claim 1, wherein the base section further includes a plurality of engaging members that are formed on the base section around the exterior surface of the upstanding wall for engagement with the article of clothing to limit movement of the article of clothing between the engaged first and second parts in said locked configuration.

11. The body protecting element of claim 10, wherein the base section has a convex shape defined by a curved top surface, the upstanding wall being formed along an apex region of the base section and the engaging members are disposed between one respective section of the upstanding wall and one peripheral edge of the base section.

12. The body protecting element of claim 10, wherein a height of each engaging member is less than a height of the upstanding wall and wherein there are spaced openings each formed partially in the base section and partially within the upstanding wall such that each opening of the spaced openings originates at a base of the upstanding wall and terminates within the upstanding wall a distance from a top edge of the upstanding wall.

13. The body protecting element of claim 1, wherein the first locking member is disposed along a top edge of the upstanding wall.

14. The body protecting element of claim 1, wherein an underside of the second part includes reinforcement ribs that extend across and define in combination with the top surface the ceiling of the hollow space when the first and second parts are mechanically coupled to one another in said locked configuration.

15. A human body protecting element for use with and attachment to an article of clothing to protect a wearer from impact and frictional forces comprising:

a first part having a first locking member, the first part having a bottom surface for placement along an inner surface of the article of clothing, the first part being defined by a continuous outer peripheral edge, the first part having a base section that defines the bottom surface and an upstanding wall that extends upwardly from the base section, wherein there are spaced openings each formed partially in the base section and partially within the upstanding wall such that each opening of the spaced openings originates at a base of the upstanding wall and terminates within the upstanding wall a distance from a top edge of the upstanding wall, wherein the first part comprises a single molded plastic part; and a second part having a second locking member that is complementary to the first locking member and results in a mechanical coupling between the first and second parts when the first and second locking members engage one another, the second part being defined by a continuous outer peripheral edge, the second part for placement along an outer surface of the article of clothing and includes an outer ground contacting contoured surface, wherein the article of clothing is captured between the first and second locking members, wherein when the first and second parts are mechanically coupled to one another, the first part extending beyond the outer peripheral edge of the second part such that the outer peripheral edge of the second part is disposed over the first part, wherein the second part comprises a single molded plastic part and represents a topmost part of the human body protecting element;

wherein the second part includes a plurality of outwardly extending tabs integrally formed in corners of the second part to allow removal of the second part from the first part after the first and second are mechanically coupled to one another, wherein the outwardly extending tabs are disposed above a base section of the first part and define a peripheral edge of the second part and the first part extends laterally beyond the peripheral edge, which includes the outwardly extending tabs, of the second part.

16. The body protecting element of claim 15, wherein the tabs are disposed in corners of the second part and overlie the first part.

17. The body protecting element of claim 15, wherein the second part has a convex shape and the tabs are disposed below a topmost section of the second part that is defined by a top surface of the second part.

18. The body protecting element of claim 17, wherein the tabs are formed along a bottom edge of the second part below a plurality of openings formed in the second part to provide air flow.

19. A human body protecting element for use with and attachment to an article of clothing to protect a wearer from impact and frictional forces comprising:

a first part having a first locking member, the first part having a bottom surface for placement along an inner surface of the article of clothing, wherein the first part has a curved base section that defines the bottom surface and a continuous upstanding wall that extends upwardly from the curved base section and from which the first locking member depends, the base section being curved in a transverse cross-sectional direction and the upstanding wall having an exterior surface, the exterior surface of the upstanding wall being inwardly spaced from a peripheral edge of the base section, the upstanding wall defining a hollow space that has an open top and is defined by an integral curved floor which comprises a portion of the curved base section and extends between the upstanding wall, the base section having a first set of openings that are formed along an exterior of the upstanding wall at a lowermost section of the upstanding wall, wherein the first part comprises a single curved part; and a second part having a second locking member that is complementary to the first locking member and results in a mechanical coupling between the first and second parts when the first and second locking members engage one another, the second part for placement along an outer surface of the article of clothing and includes an outer ground contacting contoured surface, wherein the article of clothing is captured between the first and second locking members, wherein the second part has a curved top surface, which is curved in a transverse cross-sectional direction and which serves as ceiling and covers the open top of the hollow space when the first and second parts are coupled to one another and the second part seats against a free end of the upstanding wall, the second part having a second set of openings that are formed at a location such that when the first and second parts are coupled to one another, the second set of openings are disposed outside of the hollow space and external to the upstanding wall;

wherein the curved top surface of the second part covers the coupled first and second locking members; and wherein the integral floor lies below the top surface of the second part and is covered thereby.

20. The body protecting element of claim 19, wherein the base section includes integral teeth that are configured to engage the article of clothing and wherein the first set of openings are formed between the upstanding wall and teeth.

* * * * *